US005648329A

United States Patent [19]

Blake et al.

[11] Patent Number: 5,648,329

[45] Date of Patent: Jul. 15, 1997

[54] HIGH ACTIVE PREMIX BASED ON POLYHYDROXY FATTY ACID AMIDES FOR USE IN DETERGENT COMPOSITIONS

[75] Inventors: Alan David Blake, Overijse; Jean-Pol Boutique, Genbloux(-Ernage); Jozef Philomena Geudens, Zellik; Patrick Firmin Delplancke, Zwevegem, all of Belgium

[73] Assignee: The Procter & Gamble Company, Cincinnati, Ohio

[21] Appl. No.: 608,222

[22] PCT Filed: Oct. 8, 1993

[86] PCT No.: PCT/US93/09578

§ 371 Date: Apr. 7, 1995

§ 102(e) Date: Apr. 7, 1995

[87] PCT Pub. No.: WO92/06154

PCT Pub. Date: Apr. 16, 1992

Related U.S. Application Data

[63] Continuation of Ser. No. 411,716, Apr. 7, 1995, abandoned.

[30] Foreign Application Priority Data

Oct. 13, 1992 [EP] European Pat. Off. ..... 92870164

[51] Int. Cl.[6] ..... C11D 11/00; C11D 1/52; C11D 3/04; C11D 3/32

[52] U.S. Cl. ..... 510/535; 510/337; 510/345; 510/356; 510/433; 510/465; 510/502

[58] Field of Search ..... 252/527, 529, 252/546, 548, DIG. 14, 171, 89.1; 510/535, 502, 465, 433, 345, 356, 337

[56] References Cited

U.S. PATENT DOCUMENTS

| | | | |
|---|---|---|---|
| 1,985,424 | 12/1934 | Piggott | 260/124 |
| 2,016,962 | 10/1935 | Flint | 260/127 |
| 2,703,798 | 3/1955 | Schwartz | 260/211 |
| 2,965,576 | 12/1960 | Wilson | 252/529 |
| 2,993,887 | 7/1961 | Zech | 260/211 |
| 3,654,166 | 4/1972 | Eckert et al. | 252/117 |
| 4,840,746 | 6/1989 | Shiozaki et al. | 252/174.25 |
| 5,009,814 | 4/1991 | Kelkenberg et al. | 252/548 |
| 5,158,778 | 10/1992 | Donovan et al. | 252/109 |
| 5,174,927 | 12/1992 | Honsa | 252/543 |
| 5,230,823 | 7/1993 | Wise et al. | 252/174.21 |
| 5,234,617 | 8/1993 | Hunter et al. | 252/102 |
| 5,238,009 | 8/1993 | Speckman et al. | 510/433 |
| 5,334,764 | 8/1994 | Scheibel et al. | 564/487 |
| 5,510,047 | 4/1996 | Gabriel et al. | 510/221 |

FOREIGN PATENT DOCUMENTS

| | | |
|---|---|---|
| 39 16 628 | 11/1990 | Germany . |
| 809060 | 2/1959 | United Kingdom . |
| WO-A-9206984 | 4/1992 | WIPO . |
| 9206154 | 4/1992 | WIPO . |

OTHER PUBLICATIONS

Kelkenberg, H., "Detergents Based on Sugars: New Components for Laundry Product Raw Materials and Cosmetics", *Tenside Surfactants Detergents,* vol. 25, #1 (1988) (English translation provided). No month available.

Hildreth, J.E.K., "N–D–Gluco–N–Methylalkanamide Compounds, a New Class of Non–ionic Detergents for Membrane Biohemistry", *Biochem. J.,* vol. 207 (1982), pp. 363–366. No month available.

International Search Report dated Nov. 24, 1993, for PCT/US93/09578.

*Primary Examiner*—Ardith Hertzog

*Attorney, Agent, or Firm*—Jerry J. Yetter; Jacobus C. Rasser; T. David Reed

[57] ABSTRACT

A liquid premix for use in a detergent composition which comprises at least 40% by weight of polyhydroxy fatty acid amide and an effective amount of borate-containing material to prevent crystalization and/or precipitation of the liquid premix when stored for at least 2 weeks at 20 ° C., and methods of making same.

1 Claim, No Drawings

HIGH ACTIVE PREMIX BASED ON POLYHYDROXY FATTY ACID AMIDES FOR USE IN DETERGENT COMPOSITIONS

This application is a continuation of application Ser. No. 08/411,716, filed Apr. 7, 1995, now abandoned, which was filed under 35 USC §371 based upon PCT/US93/09578, filed Oct. 8, 1993.

FIELD OF THE INVENTION

The present invention relates to a process improvement relating to the manufacture of detergent compositions, especially laundry and dishwashing detergents.

BACKGROUND OF THE INVENTION

The manufacturer may find it desirable to add any number of detersive and aesthetic ingredients to modern laundry detergent compositions using various handling techniques. For example, some sensitive ingredients such as enzymes and perfumes may be added by dry-mixing or by spraying onto a final granular product. The formulation of liquid detergents can involve various batch or continuous processes which may include various solubilizing, mixing, pH-adjusting, etc., steps. Such procedures have become well-known and commonplace in the detergent industry, and various batch, continuous and mixed continuous/batch processes for the manufacture of detergent compositions are currently in use.

Depending on the method of manufacture, the type of detergent composition being manufactured and the available equipment, it may be desirable for the manufacturer to employ various ingredients as stock solutions which are fluid in form. This especially true when formulating liquid detergents. Typically, fluid forms of detersive ingredients comprise water or water-alcohol as the fluidizing medium in which the desired ingredients can be dissolved or slurried.

While detersive surfactants are mainly water-soluble, it is well-known to those skilled in the detergency arts that various surfactants often form quite viscous fluids, or even high viscosity pasty masses or gels, when added to water at high concentrations. Such high viscosity materials can be difficult to work with in a manufacturing plant. Of course, one simple method to avoid handling problems is either to work with such surfactants in their substantially dry, solid state., to use them in a more dilute, more easily handleable, fluid form, or to heat them to provide fluidity.

However, in the event the manufacturer wishes to employ surfactants in the form of fluids which are stable and relatively highly concentrated, it is generally advantageous to adjust such fluids so that they are easier to handle, especially with regard to their ability to be pumped using conventional pumping equipment. On the other hand, it would be undesirable to add any ingredients to such surfactant-containing fluids which could not be tolerated in the finished detergent compositions, since to do so would require additional steps in the overall manufacturing process to remove such unwanted ingredients.

The polyhydroxy fatty acid amides comprise one class of surfactants which are currently being investigated for use in detergent compositions. One problem with this class of surfactants is that concentrated aqueous solutions containing them tend to precipitate and/or gel on storage, even at elevated temperatures (35°–60° C.). Moreover, low temperature storage of this family of amide surfactants is of great importance, since at elevated temperatures they are susceptible to degradation via hydrolysis of the amide bond to give the amine and the fatty acid. The polyhydroxy fatty acid amides stores below 35° C. this degradation is negligible, i.e. less than 5–10% per year, but at elevated temperatures it becomes highly significant, rising to about 10% per month at 50° C. and about 20–25% per month at 60° C.

Having due regard for the foregoing considerations, the present invention provides a method for preparing storage-stable, pumpable fluid compositions which contain relatively high concentrations of polyhydroxy fatty acid amide surfactants. Moreover, the invention provides such fluid compositions using ingredients which are either innocuous in the finished detergent composition, or which can provide desirable benefits to said finished compositions. Accordingly, removal of such ingredients is not required.

BACKGROUND ART

The manufacture of polyhydroxy fatty acid amides is disclosed in the art. The following references are illustrative of manufacturing processes: U.S. Pat. No. 2,016,962, Flint et al, issued Oct. 8, 1935; U.S. Pat. No. 1,985,424, Piggott, issued Dec. 25, 1934; U.S. Pat. No. 2,703,798, Schwartz, issued Mar. 8, 1955; U.S. Pat. No. 2,993,887, Zech, issued Jul. 25, 1961; Hildreth, Biochem. J. 1982, Vol. 207, pages 363–366; Thomas Hedley & Co Ltd. (now Procter & Gamble), British Patent 809,060 published Feb. 18, 1959; EP-A- 285 768, published Dec. 10, 1988 (see U.S. Pat. No. 5,009,814); and H. Kelkenberg, Tenside surfactants Detergents 25 (1988) 8–13.

DE 3916628, published Nov. 11th, 1990, describes compositions comprising various polyols and borates which form boric acid esters. The aim is to provide thickening agents for surfactant solutions.

WO 9206154, published Apr. 16th, 1992, describes compositions comprising polyhydroxy fatty acid amides and enzymes. Such compositions may also comprise borates as an enzyme stabiliser, but the surfactant concentration in such compositions is generally low.

WO9206984, published Apr. 30th, 1992 describes a process for the preparation of polyhydroxy fatty acid amide in the presence of a solvent to achieve a high yield with low levels of undesired impurities. The high active surfactants prepared by this process solidify or gel at temperatures around 30° C. to 50° C.

It is the aim of this invention to provide highly concentrated premixes which comprise polyhydroxy fatty acid amide at a level of at least 40%, preferably at least 60%, which are stabilised in the liquid form by the presence of a borate functional material.

It is a further aim of the invention to provide said liquid premixes which do not readily degrade by hydrolysis and which can be stored, transported and handled at temperatures of 35° C. and below without precipitation, crystallisation, solidification or gelling.

SUMMARY OF THE INVENTION

A liquid premix for use in a detergent composition which comprises at least 40% by weight of polyhydroxy fatty acid amide of the formula:

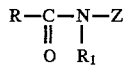

where R is $C_5$–$C_{31}$ hydrocarbyl, preferably straight-chain $C_7$–$C_{19}$ alkyl or alkenyl, $R_1$ is $C_1$-C4 hydrocarbyl and Z is polyhydroxyhydrocarbyl having a linear hydrocarbyl chain with at least 2 hydroxyls directly connected to the chain, and an effective amount of borate derived from any suitable borate functional material which prevents crystallisation and/or precipitation of said liquid premix when stored for at least 2 weeks at 20° C.

DETAILED DESCRIPTION OF THE INVENTION

The present invention provides concentrated mixtures of polyhydroxy fatty acid amides which can be stored in a stable liquid form at temperatures below 35° C., preferably about 20°–30° C. and which are pumpable.

The premixes of the present invention are useful in a wide variety of products, especially detergent products such as concentrated laundry liquids and granules. The premix is particularly useful in the processing of concentrated laundry liquids in which the formulation calls for low water levels in the finished composition.

All percentages, ratios, and proportions herein are by weight, unless otherwise specified.

By "concentrated mixture" herein is meant percentages of the polyhydroxy fatty acid amide typically in the range of at least 40% by weight, preferably 50% to 80% by weight, and most preferably from 60% to 75% by weight.

By "pumpable" herein is meant a viscosity below about 20 000 mPas, preferably below about 12 000 mPas.

"Viscosity" is measured by means of a Brookfield Viscometer Model DVII with a Thermosel System. The viscosity of the systems is measured at 20° C. during storage to assess stability.

By "stable liquid" herein is meant a homogeneous, fluid, nonbirefringent liquid. This can be estimated visually using polarised light, and can be confirmed using a microscope under polarised light. There should be no crystallisation or precipitation when a sample is examined by the naked eye.

By "effective amount" of the borate material herein is meant an amount that maintains the premix as a stable liquid and provides a premix viscosity in the desired range below about 20 000 mPas. Typically, from about 3% to about 30% of borate will suffice, preferably from about 5% to about 10%.

A key advantage of the present invention is that it allows polyhydroxy fatty acid amide surfactants to be stored in concentrated, phase stable liquid form at relatively low temperatures. This phase stability is very important, inasmuch as one of the main problems with storage of aqueous polyhydroxy fatty acid systems is that they tend to precipitate and/or gel on storage, even at relatively elevated temperatures (up to 60° C.).

Polyhydroxy Fatty Acid Amide

The polyhydroxy fatty acid amides of the present invention are of the general formula:

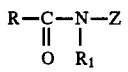

where R is $C_5$–$C_{31}$ hydrocarbyl, preferably straight-chain $C_7$–$C_{19}$ alkyl or alkenyl, $R_1$ is $C_1$–$C_4$ hydrocarbyl and Z is polyhydroxyhydrocarbyl having a linear hydrocarbyl chain with at least 2, and preferably at least 3 hydroxyls directly connected to the chain. Preferably the polyhydroxy hydrocarbyl group is derived from sugars such as glucose.

The polyhydroxy fatty acid amide can be prepared by any suitable process. One particularly preferred process is described in detail in WO 9206984. A product comprising about 95% by weight polyhydroxy fatty acid amide, low levels of undesired impurities such as fatty acid esters and cyclic amides, and which is molten typically above about 80° C., can be made by this process

Borate Functional Material

The borate functional material employed herein can be borax or boric acid or one of its salts, or mixtures thereof. Preferred salts are the alkali metal or alkanolamine salts of tetraborate or metaborate. Most preferred are sodium metaborate, monoethanolamine borate and borax.

The borate functional material may be slurried in an organic solvent, or dissolved in water before mixing with the polyhydroxy fatty acid amide. A preferred process is to mix the borate functional material with ethanol or 1,2-propane diol before adding to the molten polyhydroxy fatty acid amide, the resulting premix then being allowed to cool to the desired storage temperature.

Without wishing to be bound by theory it is believed that the borate functional materials form a complex with the hydroxyl groups of the polyhydroxy fatty acid amide which tends not to solidify or gel at temperatures of about 20° C. to 35° C. Preferably the molar ratio of the polyhydroxy fatty acid amide to the boron compound (in the $H_3BO_3$ form) is from 4:1 to 1:1, more preferably about 2:1.

Solvent

Preferably the liquid premix further comprises an organic solvent in order to maintain it in a pumpable state. Particulary suitable organic solvents are alcohols such as ethanol, 1–2 propane diol, as mixtures thereof. The level of alcohol is preferably from 1% to 40% by weight of the premix, more preferably from 10% to 25% by weight of the premix.

Hydrolysis

It has been observed that the hydrolytic degradation of the amide at 35° C. typically results in a decrease in the amide level of about 4% per month. However the premix of the present invention can be stored at 20° C., at which temperature the decrease in the level of amide is less than 1% per month.

Finished Compositions

The premix of the present invention is suitable for use in a wide range of detergent products. It is particularly suited to use in concentrated, liquid, laundry detergents. In such an application the premix will be mixed with one or more components chosen from anionic, cationic, nonionic, zwitterionic, amphoteric surfactants, fatty acids, citric acid and other builders, chelating agents, bleach and bleach activators, enzymes, suds suppressing agents, organic solvents including ethanol, 1,2-propane diol, suds suppressing agents, soil removing polymers and other ingredients known to be useful in such detergents.

EXAMPLES

Example 1

1 kg of boric acid powder was slurried in 3.65 kg of 1,2-propane diol. The resulting slurry was then mixed with 13 kg of molten C12 linear glucose amide (95% active) and allowed to cool to 20° C.

The resulting premix, which comprises 70% by weight of polyhydroxy fatty acid amide was a viscous liquid.

Example 2

1 kg of borax powder was slurried in 2 kg of 1.2-propane diol. The resulting slurry was then mixed with 8.4 kg of molten C12 linear glucose amide (95% active) and allowed to cool to 20° C.

Example 3

1 kg of monoethanolamine-borate solution was slurried in 1.85 kg of 1,2-propane diol. The resulting slurry was then mixed with 8 kg of molten $C_{12}$ linear glucose amide (95% active) and allowed to cool to 20° C. (the monoethanolamine solution of this example was prepared by mixing 21% of monoethanolamine, 63% boric acid and 16% water)

Example 4

Each of the examples 1 to 3 were repeated replacing half of the 1,2-propane diol with ethanol.

Example 5

Each of the examples 1 to 3 were repeated, and the resulting premix was further diluted with water to give activities of polyhydroxy fatty acid amide of 50% and 60%.

In all of the examples 1 to 5 the resulting premix was a viscous liquid which remained stable for at least 2 weeks at 20° C.

What is claimed is:

1. A method of making a liquid premix for use in a detergent composition, said liquid premix comprising a solvent selected from the group consisting of propylene glycol, ethanol, and mixtures thereof and at least 40% by weight of polyhydroxy fatty acid amide of the formula:

$$R-\underset{\underset{O}{\|}}{C}-\underset{\underset{R_1}{|}}{N}-Z$$

where R is straight-chain $C_7$–$C_{19}$ alkyl or alkenyl, $R_1$ is $C_1$–$C_4$ hydrocarbyl and Z is polyhydroxyhydrocarbyl derived from glucose said method comprising adding a borate functional material which is a member selected from the group consisting of borax, boric acid, and the alkali metal or alkanolamine salts of tetraborate or metaborate, in an amount effective to maintain said liquid premix as a stable homogeneous liquid of viscosity below about 20,000 mPas when stored for at least 2 weeks at 20° C.

* * * * *